US007111663B2

(12) United States Patent
Murray et al.

(10) Patent No.: US 7,111,663 B2
(45) Date of Patent: Sep. 26, 2006

(54) PRESSURE CASTING FLOW SYSTEM

(75) Inventors: Morris Taylor Murray, Briar Hill (AU); Matthew Alan Cope, Somerville (AU); Patrick William Rohan, Geelong (AU); Alan Michael Quadling, Eltham (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 9 days.

(21) Appl. No.: 10/915,709

(22) Filed: Aug. 11, 2004

(65) Prior Publication Data

US 2005/0092456 A1 May 5, 2005

Related U.S. Application Data

(63) Continuation of application No. PCT/AU03/00195, filed on Feb. 14, 2003.

(30) Foreign Application Priority Data

Feb. 15, 2002 (AU) ..... PS0585

(51) Int. Cl.
*B22D 17/00* (2006.01)

(52) U.S. Cl. ..... 164/113; 164/133; 164/900; 164/312; 164/337

(58) Field of Classification Search ..... 164/113, 164/120, 133, 900, 312, 337
See application file for complete search history.

(56) References Cited

U.S. PATENT DOCUMENTS 2,735,147 A * 2/1956 Nielsen ..... 249/205
2,763,905 A * 9/1956 Nielsen ..... 249/205

(Continued)

FOREIGN PATENT DOCUMENTS

AU PR 7214 8/2001

(Continued)

*Primary Examiner*—Kevin Kerns
*Assistant Examiner*—I.-H. Lin
(74) *Attorney, Agent, or Firm*—Jacobson Holman PLLC

(57) ABSTRACT

A metal flow system, for high pressure die casting of alloys using a machine having a pressurized source of molten alloy and a mould defining at least one die cavity, defines a metal flow path by which alloy received from the pressurized source is able to flow into the die cavity. A first part of the length of the flow path includes a runner and a controlled expansion port (CEP) which increases in cross-sectional area, in the direction of alloy flow, from an inlet end of the CEP at an outlet end of the runner to an outlet end of the CEP. A CEP exit module (CEM) forms a second part of the length of the flow path from the outlet end of the CEP. The increase in cross-sectional area of the CEP is such that molten alloy, received at the CEP inlet end at a sufficient flow velocity, undergoes a reduction in flow velocity in its flow through the CEP whereby the alloy is caused to change from a molten state to a semi-solid state. The CEM has a form which controls the alloy flow whereby the alloy flow velocity decreases progressively from the level at the outlet end of the CEP whereby, at the location at which the flow path communicates with the die cavity, the alloy flow velocity is at a level significantly below the level at the outlet end of the CEP. The change in state generated in the CEP is able to be maintained substantially throughout filling of the die cavity and such that the alloy is able to undergo rapid solidification in the die cavity and back along the flow path towards the CEP.

16 Claims, 7 Drawing Sheets

U.S. PATENT DOCUMENTS

| | | | | |
|---|---|---|---|---|
| 5,685,357 | A * | 11/1997 | Kato et al. | 164/113 |
| 6,619,370 | B1 * | 9/2003 | Sakamoto et al. | 164/113 |

FOREIGN PATENT DOCUMENTS

| | | | |
|---|---|---|---|
| AU | PR 7215 | | 8/2001 |
| AU | PR 7216 | | 8/2001 |
| AU | PR 7217 | | 8/2001 |
| AU | PR 7218 | | 8/2001 |
| EP | 0968782 | A2 | 1/2000 |
| WO | WO90/09251 | | 8/1990 |
| WO | WO99/28065 | | 6/1999 |
| WO | WO01/91946 | | 12/2001 |
| WO | WO02/16062 | | 2/2002 |
| WO | WO02/30596 | | 4/2002 |

* cited by examiner

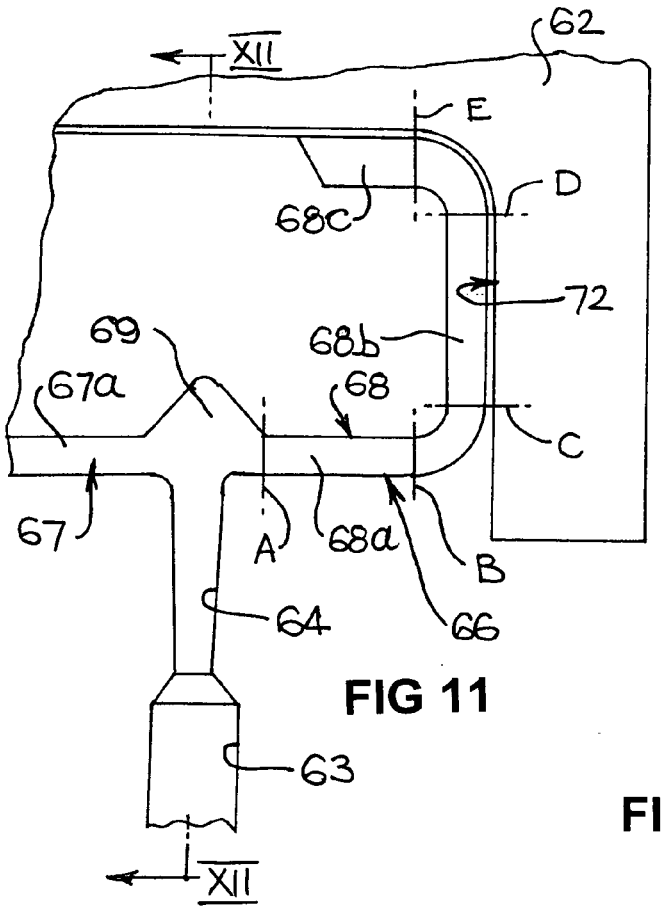
FIG 11
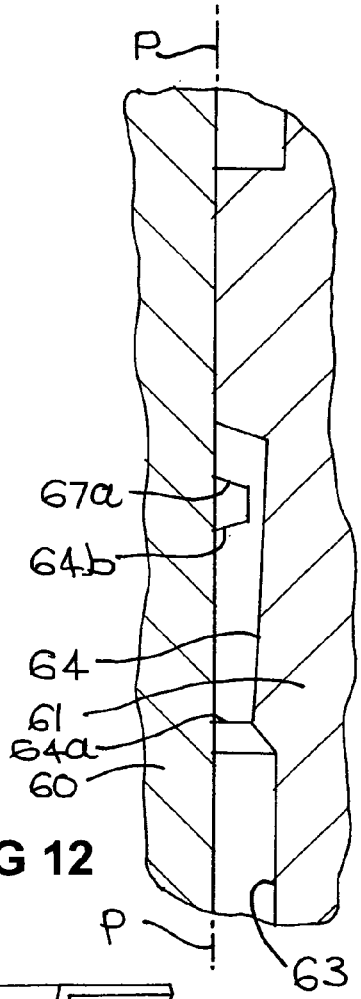
FIG 12
FIG 13
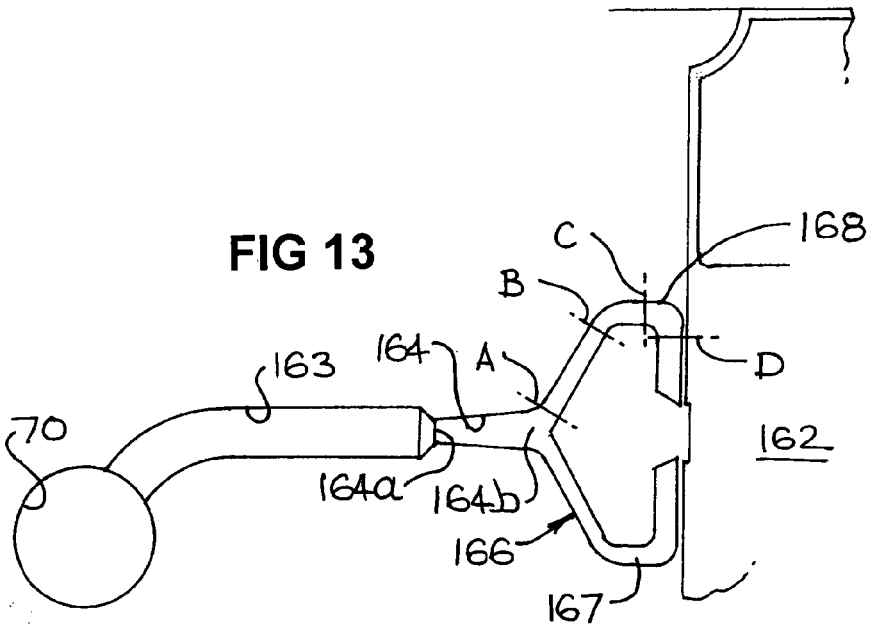

PRESSURE CASTING FLOW SYSTEM

CROSS REFERENCE TO RELATED APPLICATION

This is a continuation of PCT/AU03/00195 filed Feb. 14, 2003 and published in English.

BACKGROUND OF THE INVENTION

This invention relates to an improved alloy flow system for use in the pressure casting of alloys.

In a number of recent patent applications, we have disclosed inventions relating to the pressure casting of alloys, utilising what is referred to as a controlled expansion port (or CEP). Those applications include PCT/AU98/00987, relating to magnesium alloy pressure casting and PCT/01/01058, relating to aluminium alloy pressure casting. They also include the further applications PCT/AU01/00595 and PCT/AU01/01290, as well as Australian provisional applications PR7214, PR7215, PR7216, PR7217 and PR7218 each filed on 23 Aug. 2001. These further applications relate variously to the pressure casting of magnesium, aluminium and other pressure castable alloys and to devices and apparatus for use in pressure casting of those alloys.

As indicated, a CEP is utilised in the inventions of the above-identified patent applications. A CEP is a relatively short part of the alloy flow path which increases in cross-sectional area, from an inlet end to an outlet end of the CEP, such that alloy flowing through the CEP has a substantially lower flow velocity at its outlet end relative to the inlet end. The reduction in flow velocity is such that, in its flow through the CEP, the alloy undergoes a change in its state. That is, with molten alloy received from a pressurised source of supply to the inlet end of the CEP, the reduction in flow velocity from that attained at the inlet end to that at the outlet end is such that the state of the alloy changes from the molten state at the inlet end to a semi-solid or thixotropic state at the outlet end.

In its flow beyond the outlet end, and substantially throughout a die cavity with which the flow path communicates, the alloy most preferably is retained in the semi-solid or thixotropic state. With sufficiently rapid solidification of alloy in the die cavity, and back from the die cavity back to or into the CEP, a resultant casting produced is able to be characterised by a microstructure having fine, spheroidal or rounded primary particles of degenerate dendritic form in a matrix of secondary phase. With sufficiently rapid solidification back into the CEP, the alloy solidified in the CEP is able to have a similar, related microstructure, but with this exhibiting fine striations or banding extending transversely of the CEP, that is, transversely with respect to the direction of alloy flow through the CEP. The striations or banding are a reflection of intense pressure waves which are generated in the alloy in its flow through the CEP. Those pressure waves give rise to the formation of the degenerate dendritic primary particles in generating the change in state of the alloy from a molten to a semi-solid or thixotropic state. The intense pressure waves also cause alloy element separation on the basis of density, with this being made manifest by the striations or banding, but also by radial separation of elements in the primary particles such as in a somewhat decaying sinusoidal form.

The use of a CEP in the inventions of the above-identified patent applications gives rise to a number of highly practical benefits. A principal one of those benefits is the microstructure detailed above. The primary particles are able to be less than 40 μm in size, such as about 10 μm or less. This fine primary phase and the fine matrix of secondary phase contributes significantly to physical properties of castings, such as tensile properties, fracture toughness and hardness.

A further benefit from the use of a CEP in those inventions is that substantial cost savings are obtainable. The savings result in part from the tonnage of alloy cast, to achieve a given product weight, being substantially reduced relative to the tonnage of alloy cast for the same product weight by current practice. The runner systems of current practice are large relative to the metal flow systems of those inventions, such that the volume and hence weight of solidified metal in the feed systems used in current practice is large relative to the casting volume and weight, and thus necessitate a higher tonnage of alloy cast to achieve the same product weight. Additionally, the tonnage of alloy loss also is correspondingly reduced with the reduction in tonnage of alloy cast. Moreover, those inventions facilitate production of a given casting on a smaller machine relative to current practice. Also, for a given casting, the use of a CEP in those inventions gives rise to greater flexibility in choice of location of an inlet to a die cavity, relative to the limited choice in current practice.

In general, the CEP of the inventions of the above-mentioned patent applications increases the range of shapes and sizes of castings able to be produced. This applies where die cavity fill is by direct injection in which an inlet to a die cavity is at a location from which alloy flows outwardly to peripheral regions of the die cavity. Indeed, the use of a CEP increases the opportunity to employ direct injection for many castings. However, the increased range of shapes and sizes of castings also applies where die cavity fill is by indirect or edge feed in which an inlet to a die cavity is at a location from which alloy flows across the die cavity and then peripherally, or simply flows peripherally, to achieve die cavity fill.

There are circumstances in which, despite the benefits of using a CEP, difficulties can be encountered in obtaining optimum benefit of the inventions of the above-mentioned patent applications. These difficulties may be evident from a required microstructure not being attained fully throughout a casting, due for example to an insufficient back pressure to alloy flow, or insufficient cooling, resulting from the geometric form of the die cavity for some castings. Generally the difficulties are encountered with indirect or edge feeding arrangements in the production of castings which are small in size and/or are relatively thin or have relatively thin sections. With these castings, it is difficult to control alloy flow velocities within the die cavity and, due to this and the small die cavity volume, die cavity fill time tends to be very short. Also, while the small die cavity volume is small and results in relatively rapid alloy solidification within the die cavity, the relatively low ratio of that volume to the volume of alloy in the metal flow system tends to result in an insufficient rate of solidification back from the die cavity along the flow path of the flow system.

SUMMARY OF THE INVENTION

The present invention is directed to providing an improved alloy flow system for use in pressure casting of alloys, such as by hot- or cold-chamber die casting machines, which at least reduces the severity of the above-mentioned difficulties. At least in preferred forms, the improved system of the present invention enables those difficulties to be substantially overcome, thereby increasing the range of castings able to be produced with optimum benefit by use of a CEP.

Depending on the size and shape of a die cavity for producing a given casting, a metal flow system including a CEP in the inventions of the above-mentioned patent applications may have the outlet end of the CEP communicating directly with the die cavity. Indeed, subject to the form of a region of the die cavity with which the CEP communicates in those inventions, that region of the die cavity may define at least an outlet end portion of the length of the CEP. However, in an alternative arrangement, the flow system of those inventions communicates with the die cavity through a secondary runner such that alloy flowing beyond the outlet end of the CEP flows through the secondary runner before flowing into the die cavity. As in the case where the outlet end of the CEP opens directly to, or within, the die cavity, the secondary runner does not provide a constriction to alloy flow in the metal flow system. That is, the secondary runner has a cross-sectional area throughout its length which generally is uniform but is not less than the cross-sectional area of the outlet end of the CEP, while there is no gate or similar constriction at the outlet end of the secondary runner.

The alternative form of metal flow system, in which there is a secondary runner between the outlet end of the CEP and the die cavity, usually is used in arrangements for indirect or edge feed to a die cavity. It principally is in the context of indirect or edge feed that the present invention has its application.

A metal flow system according to the present invention defines a metal flow path by which alloy receivable from a pressurised source of alloy is able to flow into a die cavity. A first part of the flow path includes a runner and a CEP, with the CEP having its smaller inlet end at an outlet end of the runner. A second part of the length of the flow path, from the outlet end of the CEP to a location at which the flow path communicates with the die cavity, has a form which enables the flow velocity of the alloy to decrease progressively from the level at the outlet end of the CEP. The decrease in flow velocity is such that, at the location at which the flow path communicates with the die cavity, the alloy flow velocity is at a level significantly below that at the outlet of the CEP as to be appropriate for the size and form of the die cavity, such that the change in the alloy to a semi-solid or thixotropic state, generated by the CEP, is maintained substantially throughout filling of the die cavity and such that the alloy then is able to undergo rapid solidification in the die cavity and back along the flow path towards the CEP.

Thus, the invention provides a metal flow system for high pressure die casting of alloys using a machine having a pressurised source of molten alloy and a mould defining at least one die cavity, wherein the system defines a metal flow path by which alloy received from the pressurised source is able to flow into the die cavity, wherein:

(a) a first part of the length of the flow path includes a runner and a controlled expansion port (CEP) which increases in cross-sectional area, in the direction of alloy flow therethrough, from an inlet end of the CEP at an outlet end of the runner to an outlet end of the CEP; and (b) a CEP exit module (CEM) which forms a second part of the length of the flow path from the outlet end of the CEP; and wherein the increase in cross-sectional area of the CEP is such that molten alloy, received at the CEP inlet end at a sufficient flow velocity, undergoes a reduction in flow velocity in its flow through the CEP whereby the alloy is caused to change from a molten state to a semi-solid state, and wherein the CEM has a form which controls the alloy flow whereby the alloy flow velocity decreases progressively from the level at the outlet end of the CEP whereby, at the location at which the flow path communicates with the die cavity, the alloy flow velocity is at a level significantly below the level at the outlet end of the CEP, such that the change in state generated in the CEP is maintained substantially throughout filling of the die cavity and such that the alloy is able to undergo rapid solidification in the die cavity and back along the flow path towards the CEP.

The invention also provides a method of producing alloy castings using a high pressure die casting machine having a pressurised source of molten alloy and a mould defining at least one die cavity, in which the alloy flows from the source to the die cavity along a flow path, wherein:

(a) the alloy, in a first part of the flow path, is caused to flow through a controlled expansion port (CEP) which increases in cross-sectional area between inlet and outlet ends of the CEP, whereby the alloy undergoes an increase in its cross-sectional area of flow and a resultant decrease in flow velocity, from an initial sufficient flow velocity at the inlet end, thereby to produce change in the alloy from a molten state to a semi-solid state; and (b) controlling the alloy flow in a second part of the flow path, between the first part and the die cavity, whereby the flow velocity progressively decreases from the level at the outlet end of the CEP to a flow velocity where the flow path communicates with the die cavity which is at a level significantly below the level at the outlet of the CEP;

such that the change in state produced in the CEP is maintained substantially throughout filling of the die cavity.

As indicated, the second part of the flow path decreases the alloy flow velocity below the flow velocity level at the outlet end of the CEP. The second part of the flow path is herein more briefly referred to as the "CEP exit module" or "CEM".

The progressive reduction in flow velocity achieved in the CEM ensures an appropriate flow velocity at the location at which the flow path communicates with the die cavity. That flow velocity is such that, in the die cavity, the alloy is unable to revert to a significant extent, if at all, to the liquid state. In the die cavity, the flow velocity may decrease further. However, the velocity at that location is such that, even if the flow velocity tends to increase in the die cavity, whether throughout flow in the die cavity or in a localised region, the increase is unable to be to a level enabling the alloy to revert to a significant extent to a liquid state.

The arrangement of the metal flow system of the invention most preferably is such that, in its flow from and beyond the CEP, the alloy maintains a substantially coherent moving front. That is, in progressing along the CEM, the front remains substantially normal to the flow direction or is able to spread so as to progress substantially tangentially to radially diverging flow directions. A substantially coherent moving front also is able to be maintained by alloy flowing throughout the die cavity. Depending on the form of the die cavity, the front may either remain substantially normal to the flow direction, or it may spread so as to progress substantially tangentially to radially diverging flow directions in progressing to remote regions of the die cavity.

As indicated above, some alloy flow systems of the inventions of the above-identified patent applications have a secondary runner and, in some respects, this is similar to the CEM of the present invention. However, such secondary runner does not provide any significant reduction in alloy flow velocity below that at the outlet end of the CEP. Also, the CEM of the system of the present invention generally is of greater flow length than is necessary for a secondary runner of those inventions.

The CEM in the system of the invention can take a variety of forms. In a first form, the CEM defines or comprises a channel which has a width which is substantially in excess of its depth and a transverse cross-sectional area greater than the area of the outlet of the CEP. The width of the channel may exceed its depth by at least an order of magnitude. The channel is such that it enables alloy flowing into it from the CEP to spread in a radial fashion and thereby undergo a reduction in flow velocity. The cross-sectional area of the channel may increase in the direction of alloy flow to thereby cause a further decrease in alloy flow velocity.

In that first form, the channel may be substantially flat or, if appropriate for the die cavity for a given casting, it may be curved across its width. However, it alternatively can have a saw-toothed or corrugated configuration, to define peaks and troughs across its width, somewhat similar to some forms of chill vent. The channel may increase in cross-sectional area due to one of the width and depth of the channel may be constant along its length, with the other progressively increasing, preferably uniformly. However, if required, each of the width and depth may increase in the direction of alloy flow. With a saw-tooth or corrugated form, it generally is more convenient for only the width to increase, although this form has the benefit of maximising flow length for a given spacing between the CEP outlet end and the location at which the flow path communicates with the die cavity.

With the first form, in which the CEM defines a channel having a width substantially in excess of its depth, the arrangement generally is such that the alloy flow path communicates with the die cavity through an opening having a width substantially in excess of its depth. This is well suited to die cavity fill by indirect or edge feed, particularly when the die cavity is for producing a thin casting.

In a second form, the CEM defines or comprises a channel having a width and depth which have dimensions of the same order, and a transverse cross-section which progressively increases in the direction of alloy flow. This form, in having a progressively increasing cross-section, also provides a required low flow velocity at the location at which the flow path communicates with the die cavity.

Subject to the form of the die cavity at the location at which the flow path communicates with it, the channel of the second form of the CEM may be open at its end remote from the CEP, with the open end defining that location. However, it is preferred that the location is defined by an elongate opening extending along a side of the channel. In that preferred arrangement, the channel may extend substantially linearly from the CEP, along a side edge of the die cavity, with the elongate opening being along the side of the channel adjacent to the edge of the die cavity. However, it is preferred that the channel is curved, to facilitate it being of a suitable length, so as to provide an end portion of the channel remote from the CEP which extends along a side edge of the die cavity. Particularly with such curved form of channel, the flow path may be bifurcated, beyond the CEP in the direction of alloy flow, to provide at least two channels each having such an end portion with such elongate opening. In the bifurcated arrangement, the opening of each channel may provide communication with the die cavity at a common edge, or a respective edge, of the die cavity. Where two curved channels communicate with the die cavity at a common edge, the end of each channel remote from the CEP may terminate a short distance from each other, such that their side openings are longitudinally spaced along the common edge of the die cavity. However, in an alternative arrangement, the two channels may merge at those ends to thereby form respective arms of closed loop, in which case the openings again may be so spaced, or they may form a single elongate opening common to each arm.

The progressive decrease in alloy flow velocity in the CEM of the metal flow system of the invention, and the progressive increase in cross-sectional area of that second part which causes that decrease, may be continuous. Also, the progressive decrease in velocity and increase in area may be substantially uniform, or it may be step-wise, along at least a section of the second part. The first and second forms for the CEM described above are well suited to providing a continuous decrease in velocity, produced by a continuous increase in cross-sectional area, such as along at least a major part of the length of the second part.

In a third form, providing a step-wise decrease in flow velocity, the CEM includes a chamber into which alloy received from the CEP flows, with the chamber achieving a step-wise reduction in the alloy flow velocity. The CEP may communicate directly with the chamber, or communication may be by means of a channel between the CEP outlet end and the chamber. That channel has a cross-sectional area which is at least equal to that of the CEP outlet end and which may be uniform between the CEP and the chamber. However, alternatively, the channel may increase in cross-section, from the CEP to the chamber, to provide a progressive decrease in alloy flow velocity prior to the step-wise decrease achieved in the chamber.

In the third form, the CEM includes channel means which provides communication between the chamber and the die cavity and which has a form at least substantially maintaining the flow velocity level attained in the chamber. That communicating channel means may be of a form similar to that of the first form of CEM described, while it may have a substantially uniform or slightly increasing cross-section. Alternatively, the channel means may comprise at least one channel, but preferably at least two channels, similar to the second form of the CEM described above except that, if required, such channel or each such channel may have a substantially uniform cross-section.

The chamber of the third form can have a variety of suitable shapes. In one convenient arrangement, it may have the form of an annular disc. That arrangement is suitable for use where the communicating means is at least one channel. Where, in that arrangement, the communicating means comprises at least two channels, the channels may communicate with a common die cavity, or with a respective die cavity.

The at least one channel of the communicating means of the third form of CEM may open to its die cavity at an end opening of the channel, or at an elongate side opening as described with reference to the second form.

In each form of the invention, the CEM most preferably is disposed parallel to the parting plane of a mould defining the die cavity. The first part of the flow path may be similarly located, such that its runner and CEP also are parallel to that plane, with alloy received from a sprue or runner portion extending through one mould part to that plane. Alternatively, the first part of the flow path may extend through such mould part, with the outlet of the CEP at or closely adjacent to the parting plane.

As indicated above, flow velocities for achieving the required change in alloy from its molten state to a semi-solid or thixotropic state is detailed in the above-mentioned patent applications. However, for a magnesium alloy, the flow velocity at the inlet end of the CEP generally is in excess of about 60 m/s, preferably at about 140 to 165 m/s. For an aluminium alloy, the inlet end flow velocity generally is in excess of 40 m/s, such as about 80 to 120 m/s. For other alloys, such as zinc and copper alloys, capable of being converted to a semi-solid or thixotropic state, the CEP inlet end flow velocity generally is similar to that for aluminium alloys, but can vary with the unique properties of individual alloys. The reduction in flow velocity to be achieved in the CEP generally is such as to achieve a flow velocity at the CEP outlet end which is from about 50 to 80%, such as from 65 to 75% of the flow velocity at the inlet end.

The reduction in flow velocity to be achieved in the CEM of the system of the invention, below the flow velocity attained at the outlet end of the CEP will vary with the size and form of castings to be produced. However, in general, the CEM reduces the flow velocity such that the flow velocity into the or each die cavity is from about 20% to 65% of the flow velocity at the outlet end of the CEP. Depending on the die cavity form, the flow velocity may be able to increase therein, in at least some regions, although it generally is preferred that the alloy flow velocity further decreases throughout the die cavity. When the flow velocity is able to increase in at least a region of the die cavity, this preferably results in an increase to not more than about 75% of the flow velocity at the outlet end of the CEP.

The preceding description of the invention makes reference to a die cavity or the die cavity. However, it is to be understood that the invention is applicable to multi-cavity moulds. In such case, the CEM defined by the system of the invention may divide or extend to provide separate flow to a common die cavity or to each of at least two die cavities. Indeed, as illustrated herein by reference to the drawings, providing such separate flow from a common CEP generally facilitates attainment of the required reduction in alloy flow velocity.

BRIEF DESCRIPTION OF THE DRAWINGS

In order that the invention may more readily be understood, description now is directed to the accompanying drawings, in which:

FIG. 11 is similar to FIG. 3, but illustrates a fifth embodiment of the invention;

FIG. 12 is a part sectional view taken on line XII—XII of FIG. 1;

FIG. 13 is similar to FIG. 11, but shows a first variant of the fifth embodiment of the invention;

DETAILED DESCRIPTION OF THE DRAWING

Figure 1:
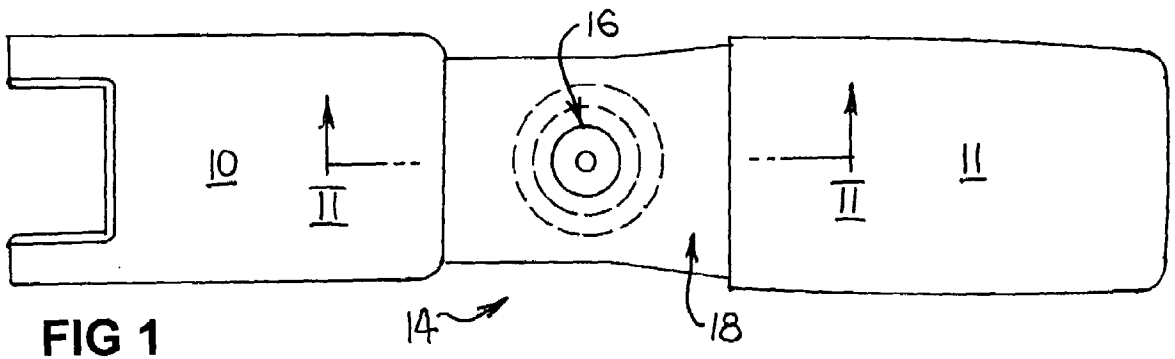
FIG. 1 is a schematic representation of a two cavity mould arrangement, taken on the parting plane between fixed and movable mould parts, illustrating a first embodiment of the invention.
Figure 2:
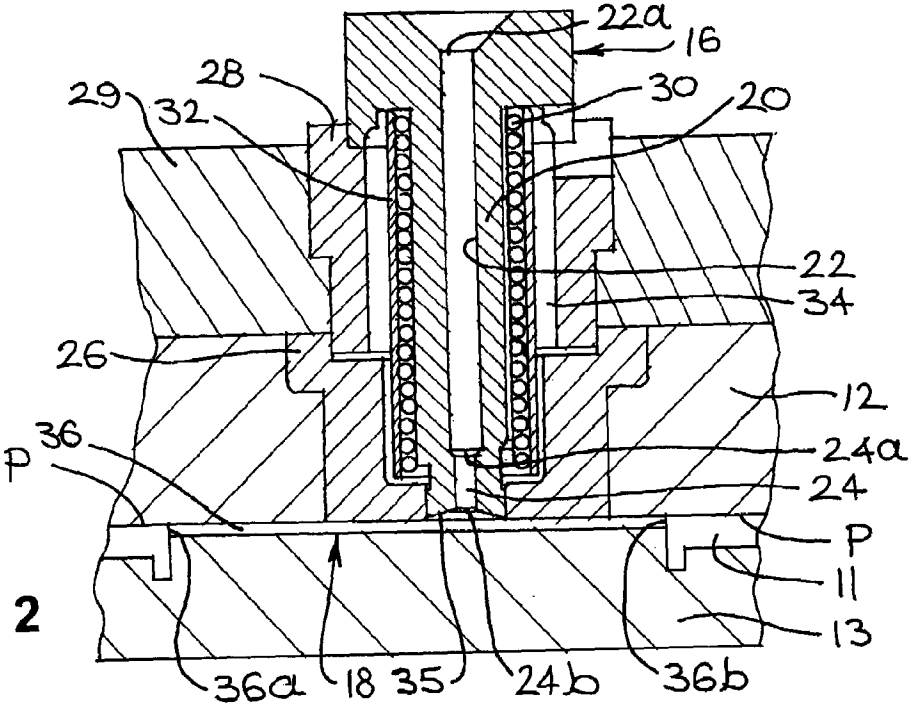
FIG. 2 is a sectional view taken on line II of FIG. 1 and shown on an enlarged scale.

With reference to FIGS. 1 and 2, there is represented therein two die cavities 10 and 11, defined by fixed mould half 12 and movable mould half 13 and each for use in producing a respective casting in a high pressure casting machine (not shown). Each of die cavities 10 and 11 is arranged to receive alloy from a pressurised supply of molten alloy of the machine, with alloy passing to each cavity by a common alloy feed system 14 according to a first embodiment of the present invention. The embodiment is one in accordance with the first form of the invention as described above.

The alloy feed system 14 defines an alloy flow path which has a first part defined by nozzle 16, shown in more detail in FIG. 2, and a second part 18, referred to as a CEM as identified earlier herein, which extends between each cavity and across the outlet end of nozzle 16.

In overall form and detail, nozzle 16 is in accordance with the invention of the above-mentioned patent application PCT/AU01/01290. As shown in FIG. 2, nozzle 16 includes an elongate annular housing 20 by which the first part of the metal flow path defines a bore comprising a runner 22 and, at the outlet end of the runner 22, a CEP 24. Housing 20 has its outlet end neatly received in an insert 26 of fixed mould half 12, while its inlet end abuts against a fitting 28 of platen 29. Around housing 20 there is an electric resistance coil 30 and, outside coil 30, a layer of insulation 32. Also, an insulating gap 34 is provided between insulation 32 and insert 26, except for a short distance at the outlet end of housing 20 where it is in metal to metal contact with insert 24, while gap 34 also extends between insulation 32 and fitting 28. As disclosed in PCT/AU01/01290, coil 30 and insulation 32 provide for control of heat energy level of housing 20 and the temperature of alloy flowing through runner 22 and CEP 24.

In the arrangement of nozzle 16, runner 22 is of constant cross-section throughout its length, except for a short distance at its outlet end at which it tapers down to the cross-section of the inlet end 24*a* of CEP 24. From its inlet end 24*a*, the cross-section of CEP 24 increases uniformly to its outlet end 24*b*. The arrangement is such that, at the alloy flow rate set by the machine in supplying molten alloy to the inlet end 22*a* of runner 22, the alloy attains a suitable relatively high flow velocity at inlet end 24*a*, and a suitable relatively low flow velocity at outlet end 24*b*, of CEP 24. The suitable flow velocities are such that intense pressure waves are generated in the alloy in CEP 24 such that the alloy undergoes a change in its state from liquid to semi-solid or thixotropic. The suitable flow velocities vary with the alloy concerned and, while they are detailed in the above-mentioned patent applications, they also are discussed later herein.

In the arrangement shown, the bore of housing 20 flares over a very short end portion 35, beyond the outlet end 24*b* of CEP 24. This may provide a transition to the CEM 18 of the metal flow path and, like CEM 18, serves to further reduce the flow velocity of the alloy relative to its level at end 24*b* of CEP 24. Alternatively, that flared end portion 35 may co-operate with a spreader cone, such as described with reference to FIGS. 3 and 4, in which case the flared end portion 35 may provide a further significant reduction in alloy flow velocity.

The CEM 18 of the alloy flow path is defined by a shallow, rectangular channel 36 into the centre of which the bore of housing 20 opens. Channel 36 is defined by mould halves 12 and 13, and has its width and length dimensions parallel to the parting plane P-P between mould halves 12 and 13. Thus, channel 36 is perpendicular to nozzle 16.

Channel 36 provides alloy flow to each of the die cavities 10 and 11 in which the alloy flow velocity decreases below the level prevailing at outlet end 24*b* of CEP 24. This is achieved by the alloy spreading radially outwardly in channel 36, from end 24*b*, as represented by the broken circles shown in FIG. 1. Thus, the alloy is retained in the semi-solid or thixotropic state achieved in the CEP and, in that state, the alloy progresses on an expanding front in channel 36 which is tangential to radial directions from end 24*b*. The expanding flow of alloy is constrained on reaching the opposite sides of channel 36, but is divided to continue to flow at a reduced flow velocity to each of open ends 36*a* and 36*b* of channel 36 by which channel 36 communicates with die cavities 10 and 11, respectively. Over the portion of channel 36 leading to die cavity 10, the opposite sides of channel 36 are substantially parallel, such that the reduced flow velocity may be attained a short distance before open end 36*a*. However, for the portion of channel 36 leading to cavity 11, the opposite sides diverge in the flow direction, such that the flow velocity is able to continue to decrease to obtain the reduced flow velocity at open end 36*b*.

Alloy flow continues to achieve filling of each die cavity 10,11. Alloy flow throughout each of cavities 10,11 is able to be at a sufficiently low flow velocity, below the flow velocity at end 24*b* of CEP 24, that back pressure against alloy flow is able to maintain the alloy in a semi-solid or thixotropic state. That is, even though there may be a region of either die cavity in which flow velocity may increase, such increase is not able to be sufficient to enable any significant, localised reversion of alloy back to a liquid state.

The arrangement of mould halves 12,13 is such that heat energy extraction from alloy in each die cavity 10,11, on completion of cavity fill, provides rapid solidification of alloy in each cavity 10,11 and back along channel 36 to the CEP. The thin cross-section of channel 36 facilitates this. Also, heat energy extraction, principally by die half 12 and its insert 26, enables that cooling to progress back into the CEP, despite heating by coil 30, due to the metal to metal contact between housing 20 and insert 26, around end 24*b* of CEP 24.

Figure 3:
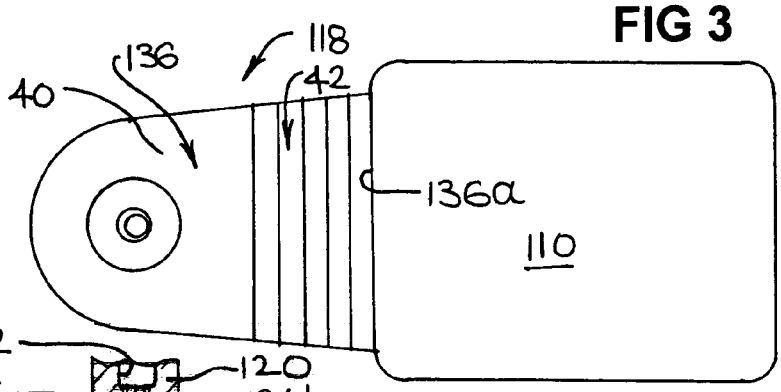
FIG. 3 is a schematic representation, similar to FIG. 1, but illustrating a second embodiment of the invention having a single die cavity.
Figure 4:
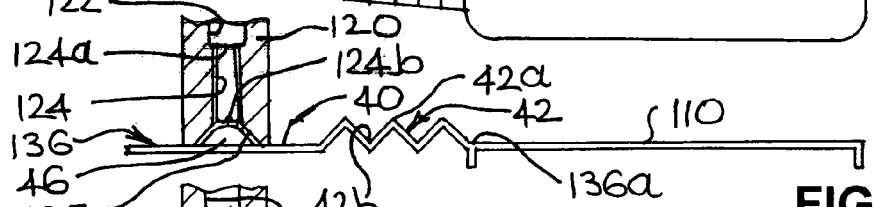
FIG. 4 is a side elevation of the arrangement of FIG. 3.

FIGS. 3 and 4 show a second embodiment of an arrangement for producing a casting, in this case using a single cavity mould of a high pressure casting machine. The second embodiment also is in accordance with the first form of the invention as described above, but utilises a saw-toothed like channel form, rather than a flat channel as in FIGS. 1 and 2. Parts corresponding to those of FIGS. 1 and 2 have the same reference numeral, plus 100. However, the mould halves are not shown, while only part of housing 120 of a nozzle 116 is illustrated.

In FIGS. 3 and 4, the end of channel 136 of CEM 118 has a round-ended flat portion 40 with which the CEP 124 communicates. Also, as indicated above, channel 136 has a portion 42, between portion 40 and die cavity 110 which has a saw-toothed form defining peaks 42*a* and troughs 42*b* which extend transversely with respect to the direction of alloy flow through portion 42.

While the movable die half is not shown, there is illustrated a spreader cone 46 of that half. With the mould die halves clamped together, cone 46 is received within flared end portion 135 of the bore of nozzle housing 120, beyond the outlet end 124*b* of CEP 124. Thus, semi-solid or thixotropic alloy flowing from CEP 124 spreads frusto-conically prior to entering channel 136. Depending on the cone angles of portion 135 and core 46, the flow velocity of alloy entering channel 136 may be the same as, or slightly different from that attained at outlet end 124*b* of CEP 124, although it usually will be substantially unchanged.

Within channel 136, the alloy first spreads radially and thereby decreases in flow velocity. On flowing through portion 42 of channel 136, the flow velocity is further decreased through to open end 136*a*, due to the opposite sides of channel 136 diverging to end 136*a*. Thus, alloy flowing into and filling die cavity 110 is able to be maintained in a semi-solid or thixotropic state. The saw-toothed like configuration (with one or more than one tooth) of portion 42 of channel 136 increases the back-pressure, thereby assisting in maintaining the alloy in that state. Apart from the differences detailed, overall performance with the arrangement of FIGS. 3 and 4 is substantially as described with reference to FIGS. 1 and 2.

Figure 5:
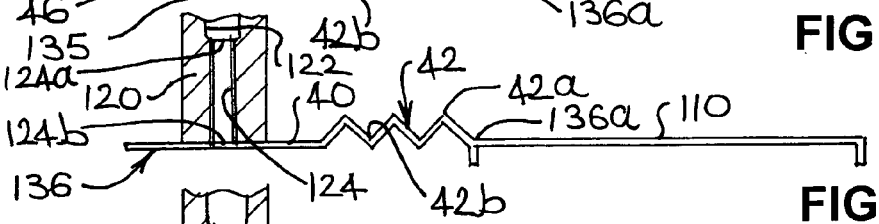
FIG. 5 is similar to FIG. 4, but shows a first variant of the second embodiment.

FIG. 5 shows a first variant of the embodiment of FIGS. 3 and 4. The variant of FIG. 5 is the same in overall form to that of FIGS. 3 and 4, except that the outlet end 124*b* of CEP 124 communicates directly with channel 136. That is, there is no flared portion for the bore of housing 120, and a spreader cone therefore is not required.

Figure 6:
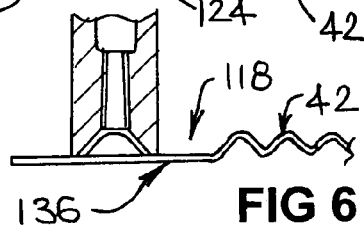
FIG. 6 is similar to FIG. 4 but shows a second variant of the second embodiment.

The partial view of FIG. 6 (in which the die cavity is not shown) illustrates a second variant of the embodiment of FIGS. 3 and 4. The variant of FIG. 6 is the same in overall form as FIGS. 3 and 4, except that portion 42 of the channel 136 of the CEM 118 is of an undulating or corrugated configuration, rather than saw-toothed. However, that configuration of FIG. 6 again provides suitable back-pressure.

Figure 7:
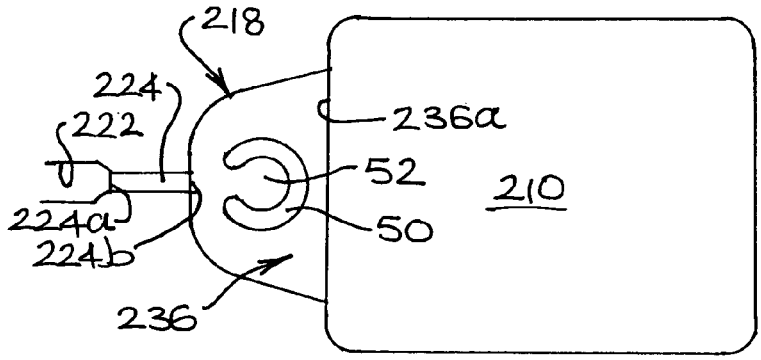
FIG. 7 is similar to FIG. 3, but illustrates a third embodiment of the invention.
Figure 8:
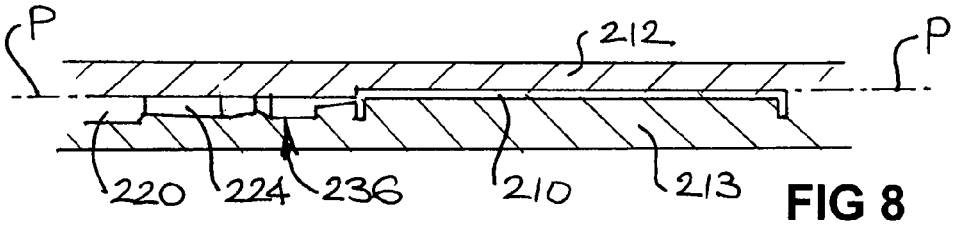
FIG. 8 is a side elevation of the arrangement of FIG. 7.

The third embodiment of FIGS. 7 and 8 also is in accordance with the first form of the invention as described above. In the arrangement of FIGS. 7 and 8, parts corresponding to those of FIGS. 1 and 2 have the same reference numeral, plus 200.

As with the embodiment of FIGS. 3 and 4, the third embodiment of FIGS. 7 and 8 is for producing a casting using a single cavity mould. However, in this case, channel 236 of the CEM 118 does not include a portion of saw-toothed configuration. Rather, channel 236 has flat top and bottom main surfaces. Also, while those surfaces converge slightly in the direction of alloy flow therethrough, to outlet end 236*a* and cavity 210, the opposite sides of channel 236 diverge in that direction. The arrangement is such that, in the flow direction, channel 236 increases in transverse cross-sectional area towards the elongate, thin open end 236*a*, such that alloy flow velocity progressively decreases to a suitable level below that at outlet end 224*b* of CEP 224.

In the embodiment of FIGS. 7 and 8, runner 222 and CEP 224 extend parallel to the parting plane P-P between mould halves 212,213, and provide communication with the end of channel 236 remote from die cavity 210. The runner 222 and CEP 224 are defined by the halves 212,213, rather than by a nozzle, while they are aligned with a centre-line of channel 236 of the CEM 218 and cavity 210. The supply of molten alloy to the inlet end of runner 222 may be via a main runner or the bore of a nozzle, with such main runner or nozzle bore not including a CEP, and extending through fixed mould half 212, such as perpendicularly with respect to plane P-P.

Within channel 236, there is an arcuate wall 50 which extends between the top and bottom main surfaces of channel 236. Wall 50 defines a recess 52 which opens towards the outlet end 224*b* of CEP 224, such that any solid slug or the like from a previous casting cycle, carried into chamber 236 with the alloy, is able to be captured and retained.

Figure 9:
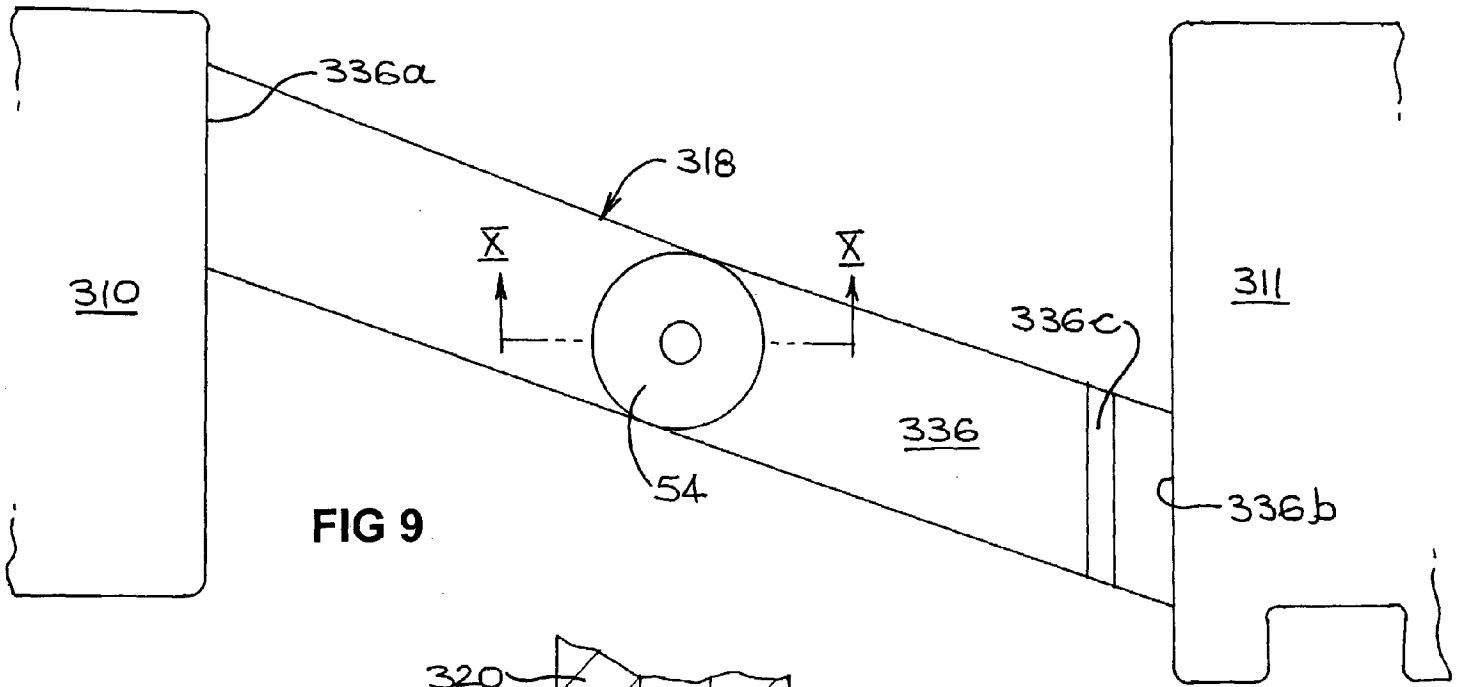
FIG. 9 is a schematic representation, similar to FIG. 1, but illustrating a fourth embodiment of the invention.

Operation with the embodiment of FIGS. 7 and 9 generally will be appreciated from description in respect of FIGS. 1 and 2, and of FIGS. 3 and 4.

Figure 10:
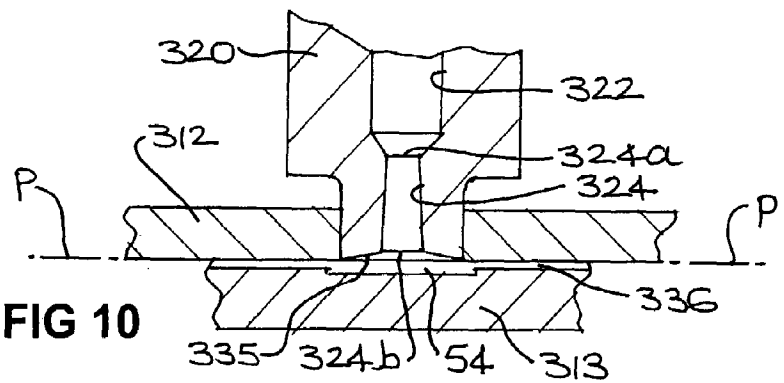
FIG. 10 is a part sectional view taken on line X—X of FIG. 9.

The fourth embodiment of FIGS. 9 and 10 is similar in many respects to the first embodiment of FIGS. 1 and 2. FIGS. 9 and 10 also are in accordance with the first form of the invention as described above, and the parts corresponding to those of FIGS. 1 and 2 have the same reference numeral, plus 300.

In the embodiment of FIGS. 8 and 9, the arrangement again provides for the production of castings, using a high pressure casting machine. The machine has a mould which defines two die cavities 310,311 between its mould halves 312,313. The die halves also define an elongate channel 336 which extends between cavities 310,311, parallel to the parting plane P-P. The channel 336 forms the CEM 318 of an alloy flow path of which the first part is provided by a runner 322 and CEP 324. The runner 322 and CEP 324 are defined by the housing 320 of a nozzle mounted in the fixed mould half 312 at right angles to plane P-P. The CEP 324 communicates with channel 336 mid-way between cavities 310,311, such that the alloy is divided to flow in opposite directions to each cavity 310,311.

From the outlet end 324*b* of CEP 324, the alloy spreads in end portion 335 of the bore of housing 320 and then enters a central region 54 of channel 336. At the region 54, the depth of channel 336 is increased such that region 54 provides a circular recess which can assist in stabilising alloy flow. From region 54, the alloy is divided so as to flow in opposite directions to each open end 336*a* and 336*b* of channel 336, and then into the respective die cavity 310,311.

Molten alloy received into runner 322, from a pressurised source of the machine, is caused to undergo a decrease in flow velocity in CEP 324, from that attained at end 324*a*, to that attained at end 324*b*, of CEP 324. The decrease is such that the alloy state is changed from molten to semi-solid or thixotropic. The remainder of the alloy flow path is such that the flow velocity is further decreased through to respective open ends 336*a*,336*b* of channel 336. This further decrease results from the alloy spreading radially from the outlet end of housing 320, in region 54, to the extent permitted by the opposite sides of channel 336. The alloy then flows along channel 336, to each of the opposite ends 336*a* and 336*b*, in which the flow velocity continues to decrease due to the opposite sides diverging slightly from region 54 to the opposite ends 336*a*, 336*b*. Finally, as channel 336 is inclined at an angle to the end of each die cavity 310,311 at which open ends 336*a* and 336*b*, respectively, provide communication, the ends 336*a* and 336*b* have a greater area than transverse cross-sections normal to the longitudinal extent of channel 336, thereby enabling a further reduction in alloy flow velocity at ends 336*a* and 336*b*.

The arrangement is such that alloy passing through open ends 336*a* and 336*b* has a flow velocity which is substantially lower than the flow velocity at the outlet end 324*b* of CEP 324. The substantially lower flow velocity is such as to maintain the alloy in the semi-solid or thixotropic state, and to facilitate maintenance of that state during filling of die cavities 310,311. The arrangement also facilitates rapid solidification of alloy in cavities 310,311, on completion of die fill, such that solidification is able to proceed rapidly back from cavities 310,311, along channel 336 and into CEP 324.

In one working example in accordance with FIG. 9, utilising a 12 mm long CEP, the cross-sectional area of the CEP increased by 30% from its inlet end 324*a* to its outlet end 324*b*. This increase achieved corresponding reduction in flow velocity, and a change in the alloy from a molten state at end 324*a* to a semi-solid or thixotropic state at end 324*b*. In that working example, the combined area of open ends 336*a*,336*b* of channel 336 was about 45% greater than the area at CEP outlet end 324*b*, resulting in a corresponding further reduction in flow velocity at ends 336*a*,336*b*. In this regard, it will be appreciated that while each open end 336*a*,336*b* has an area less than that at CEP end 324*b*, each open end 336*a*,336*b* accommodated approximately half of the total alloy flow (as in the case of ends 36*a*,36*b* of the arrangement of FIGS. 1 and 2).

In the working example, the open ends 336*a*,336*b* had a width of 30 mm and a depth of 0.9 mm. The die cavity 310 had a 2 mm depth dimension normal to the plane P-P, while the cavity 311 had a corresponding dimension of 1 mm. In each die cavity, the alloy was able to flow on a front, to achieve die cavity fill, which spreads as it moved away from the respective open end 336*a*,336*b*. Thus, alloy flow velocity further decreased in each cavity 310,311, offsetting any tendency for the alloy to revert to a liquid state.

In the arrangement of FIGS. 9 and 10, the inclination of open ends 336*a*,336*b* is such as to direct alloy across a corner of the respective cavity 310,311, and this is found to be beneficial. This inclination has been found to increase back-pressure against alloy flow, which assists in maintaining the alloy in a semi-solid or thixotropic state. Also, adjacent to end 336*b*, channel 336 was provided with a short length 336*c* which was inclined with respect to plane P-P, with this also assisting maintenance of a suitable back-pressure.

FIGS. 11 and 12 illustrate a fifth embodiment of the invention which is in accordance with the second form of the invention described above. In FIGS. 11 and 12, the alloy flow system shown has an alloy flow path which extends parallel to the parting plane P-P between fix mould half 60 and movable mould half 61, to die cavity 62. The flow path includes a runner 63 in line with a CEP 64 which together define a first part of the flow path. The second part of the flow path comprises a CEM in the form of a channel 66 which has oppositely facing C-shaped arms 67,68. Only part of arm 67 is shown, although it is of the same form as arm 68, but oppositely facing.

Each arm 67,68 of CEM channel 66 has a respective first portion 67*a*,68*a* which extends laterally outwardly from an enlargement 69 at the outlet end 64*b* of CEP 64. From the outer end of portion 68*a*, arm 68 has a second portion 68*b* which extends in the same direction as, but away from, CEP 64. Beyond portion 68*b*, arm 68 has a third portion 68*c* which extends laterally inwardly towards a continuation of the line of CEP 64. While not shown, arm 67 also has respective second and third portions, beyond portion 67*a*, which correspond to portions 68*b* and 68*c* of arm 68. Each arm 67,68 provides communication with the die cavity 62, within a U-shaped recess 72 at an end of cavity 62.

Runner 63, CEP 64 and channel 66 are of bi-laterally symmetrical trapezoidal form in transverse cross-section, as shown for portion 67*a* of arm 67 in FIG. 12. Runner 63 is of uniform cross-sectional area over the major part of its length but, adjacent to its outlet end, it tapers down to the area at the inlet end 64*a* of CEP 64. From end 64*a*, CEP 64 increases in cross-sectional area to its outlet end 64*b*. From the enlargement 69 of the flow path, each arm 67,68 of channel 66 increases in cross-sectional area to a maximum adjacent to its remote end.

A working example was based on FIGS. 11 and 12, and used for production of magnesium alloy castings on a hot chamber pressure die casting machine with a single die cavity mould. The arrangement was such that molten magnesium alloy from the machine source was supplied under pressure to the inlet end of runner 63 in which the flow velocity was 50 m/sec. At the tapered outlet end of the runner, the flow velocity was increased to attain 150 m/s at the inlet end 64*a* of CEP 64. From end 64*a*, the flow velocity in CEP 64 decreased to a level of 112.5 m/s at outlet end 64*b*. From enlargement 69, the alloy divided equally for flow along each arm. Relative to the locations A to E shown for arm 68, the alloy flow velocity decreased progressively to 90 m/sec at A, 80 m/sec at B, 70 m/sec at C, 60 m/sec at D, and 50 m/sec at E.

Each arm was provided with an elongate opening by which it was in communication with the die cavity 62. Relative to the locations C,D,E and the end of arm 68, the opening for arm 68 (and similarly for arm 67) had an average width of 0.5 mm from C to D, of 0.6 mm from D to E and of 0.8 mm from E to the end. The overall length of each slot was 35.85 mm, with the overall flow velocity therethrough decreasing from 70 m/sec at C to less than 50 m/s at the end of each arm beyond E.

In the production of each casting, the alloy state changed from molten in the runner 63, to semi-solid or thixotropic in the CEP 64. That change was retained throughout flow along channel 66 and throughout the die cavity fill. The castings were of exceptional quality and microstructure, resulting from maintenance of the alloy in a semi-solid or thixotropic state, and rapid solidification in the die cavity and then back along the channel 66 into CEP 64.

FIG. 13 shows a variant on the arrangement of FIGS. 11 and 12, and corresponding parts have the same reference numerals, plus 100. FIG. 13 shows a main runner 70 by which alloy is supplied to runner 163. In this instance, arms 167,168 of CEM channel 166 each communicate with the die cavity along a straight end of the cavity. The CEP 164, for use with a magnesium alloy, provides for a reduction in flow velocity of 150 m/sec at inlet end 164*a* to 112 m/sec at outlet end 164*b*. In each arm of channel 166, the flow velocity decreases further to 95 m/sec at A, 85 m/sec at B, 75 m/sec at C and 65 m/sec at the end of each arm 167,168. The opening from each arm to the die cavity is from just before each location D to the end of each arm. Operation with this arrangement is as described for FIGS. 11 and 12.

Figure 15:
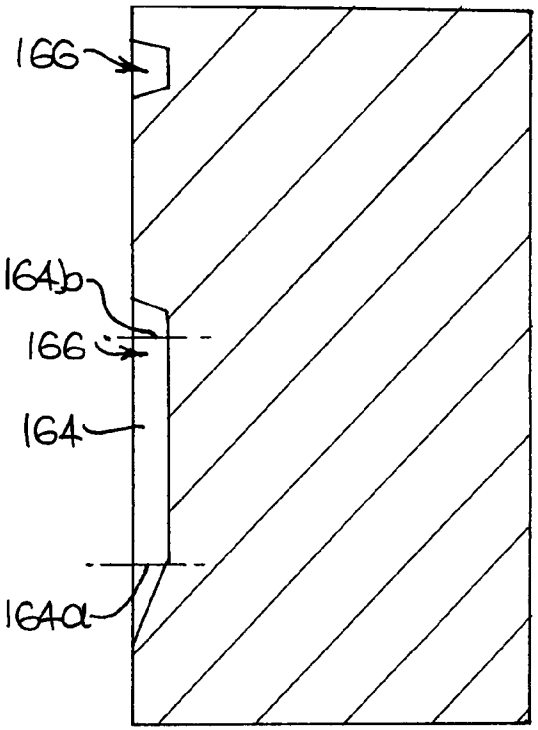
FIG. 15 is a part sectional view taken on line XV—XV of FIG. 14.
Figure 14:
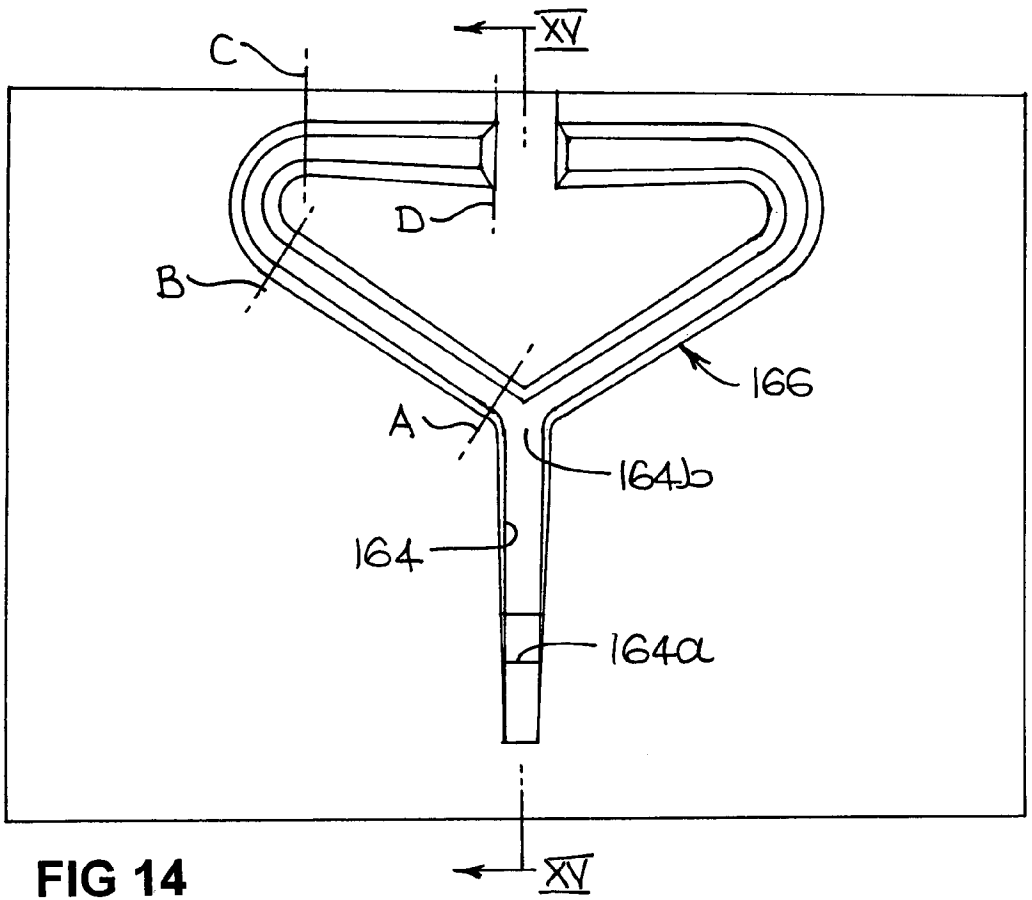
FIG. 14 is similar to FIG. 11, but shows a second variant of the fifth embodiment.

FIGS. 14 and 15 show more precise detail for the variant of FIG. 13, for the CEP 164 and channel CEM 166. For this, suitable cross-sectional areas for a magnesium-alloy and flow velocities as detailed in relation to FIG. 13 are as follows:

| Location | Area ($mm^2$) |
|---|---|
| 164a | 6.4 |
| 164b | 8.5 |
| A | 6.0 |
| B | 6.8 |
| C | 8.0 |
| D | 9.6. |

As will be appreciated, the areas shown for locations A to D are for one arm of CEM channel 166. However, relating these to the areas for CEP 164 needs to take into account the fact that each arm provides for the flow of only half of the alloy flowing through the CEP.

Figure 16:
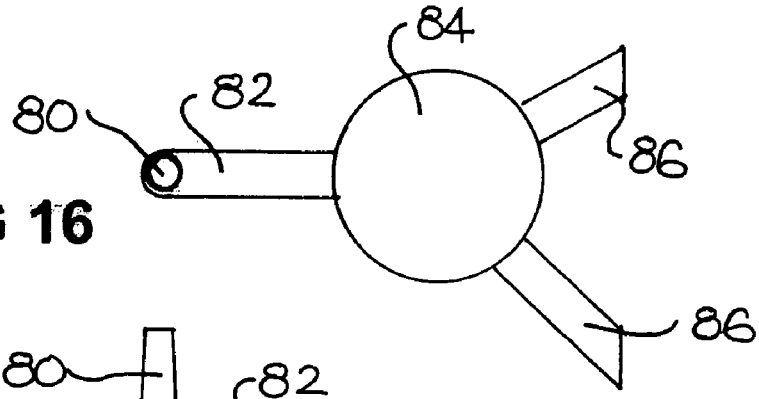
FIG. 16 is similar to FIG. 3, but illustrates a sixth embodiment of the invention.
Figure 17:
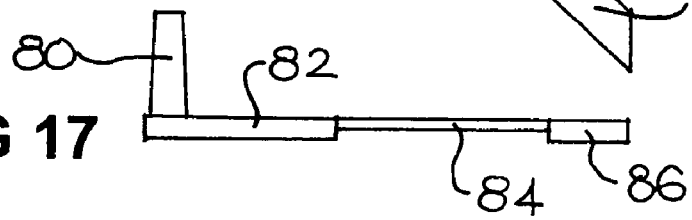
FIG. 17 is a side elevation of the arrangement of FIG. 16.
Figure 18:
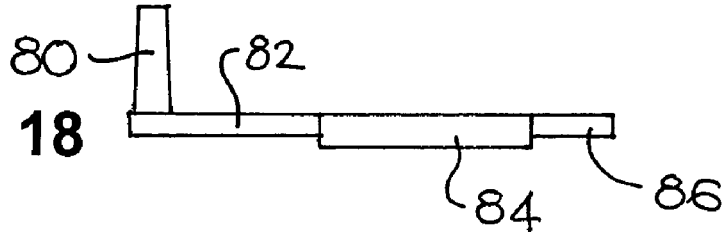
FIG. 18 is similar to FIG. 17, but illustrates a variant on the sixth embodiment.

FIG. 16 shows part of the flow system for a further embodiment of the present invention, viewed perpendicularly of a parting plane. FIGS. 17 and 18 show alternatives for the arrangement of FIG. 16.

In FIGS. 16 to 18, the runner by which molten alloy flows to the CEP 80 is not shown. However, it and CEP 80 form the first part of the flow path of the flow system, while channel 82, chamber 84 and channels 86 form the second part or CEM of the flow system. Alloy, after undergoing a change of state to semi-solid or thixotropic in CEP 80 flows to channel 82, into chamber 84, and then through each channel 86 to a single or respective die cavity (not shown). Channel 82 has a larger cross-sectional area than the outlet end of CEP 80, and the cross-sectional may be constant or it may increase to chamber 84. In either case, it provides a lower alloy flow velocity than that attained at the outlet end of CEP 80. In chamber 84, the alloy flow is able to spread, resulting in a further reduction in flow velocity. From chamber 84, the alloy flow divides to extend along each channel 86 and, like channel 82, each of channels 86 provides for a further reduction of alloy flow velocity therein or therealong. Given the division of alloy flow, channels 86 may have a lesser cross-sectional area than channel 82, while still achieving a reduction in flow velocity.

Chamber 84 may be thinner than channel 82 and channels 86 as shown in FIG. 17, or it may be thicker as shown in FIG. 18. It alternatively may be of similar thickness to the channels.

Operation with the arrangement of FIGS. 16 to 18 generally will be understood from description with reference to preceding embodiments.

Figure 19:
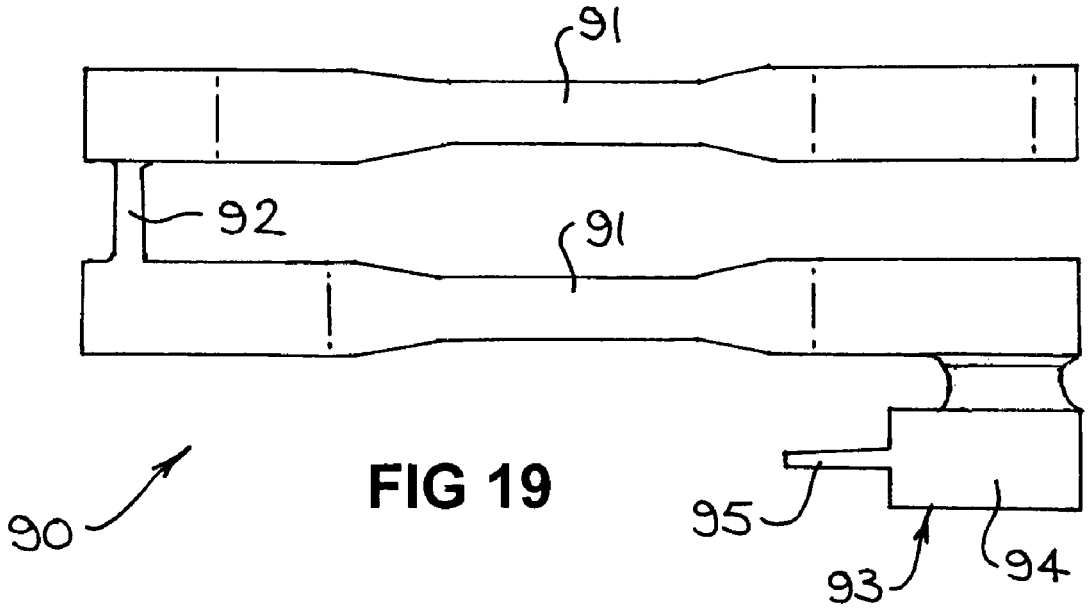
FIG. 19 is a plan view of a casting produced using a seventh embodiment of the present invention.

FIG. 19 illustrates a casting 90 produced using a further embodiment of the present invention. The casting comprises a pair of laterally adjacent tensile bars 91 joined in series at adjacent ends by a tie 92 of metal which solidified in a channel providing for metal flow between respective die cavities in which the bars 91 were cast. The casting 90 is illustrated in the condition in which it is released from the mould and it accordingly includes metal 93 solidified along part of the metal flow path by which alloy was supplied to the die cavities. The metal 93 includes metal section 94 solidified in the CEM, and metal section 95 solidified in the CEP, of the metal flow path.

Figure 21:
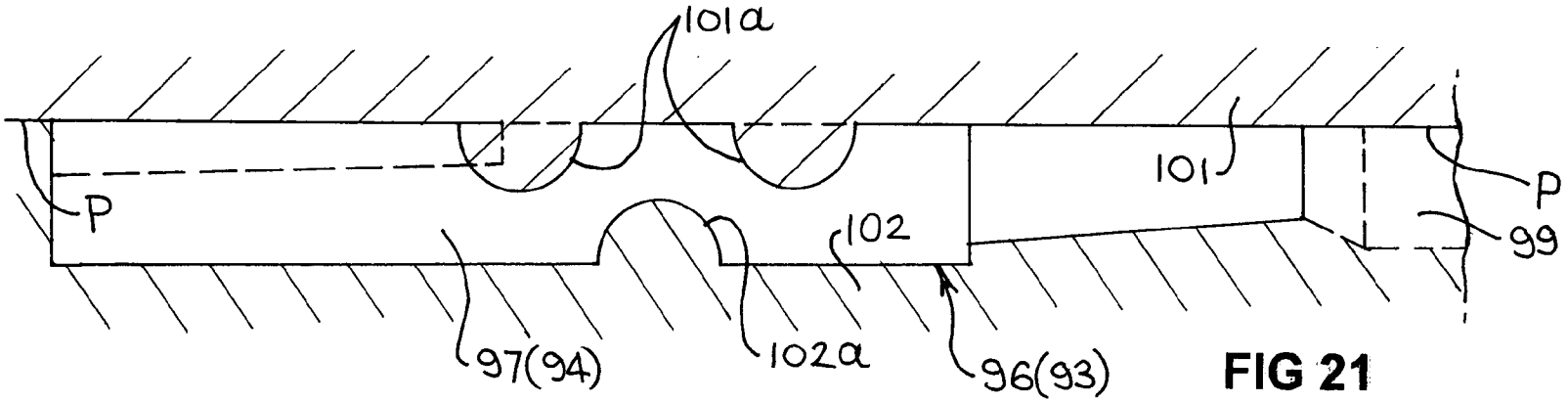
FIG. 21 is a side elevation of the arrangement shown in FIG. 20.
Figure 20:
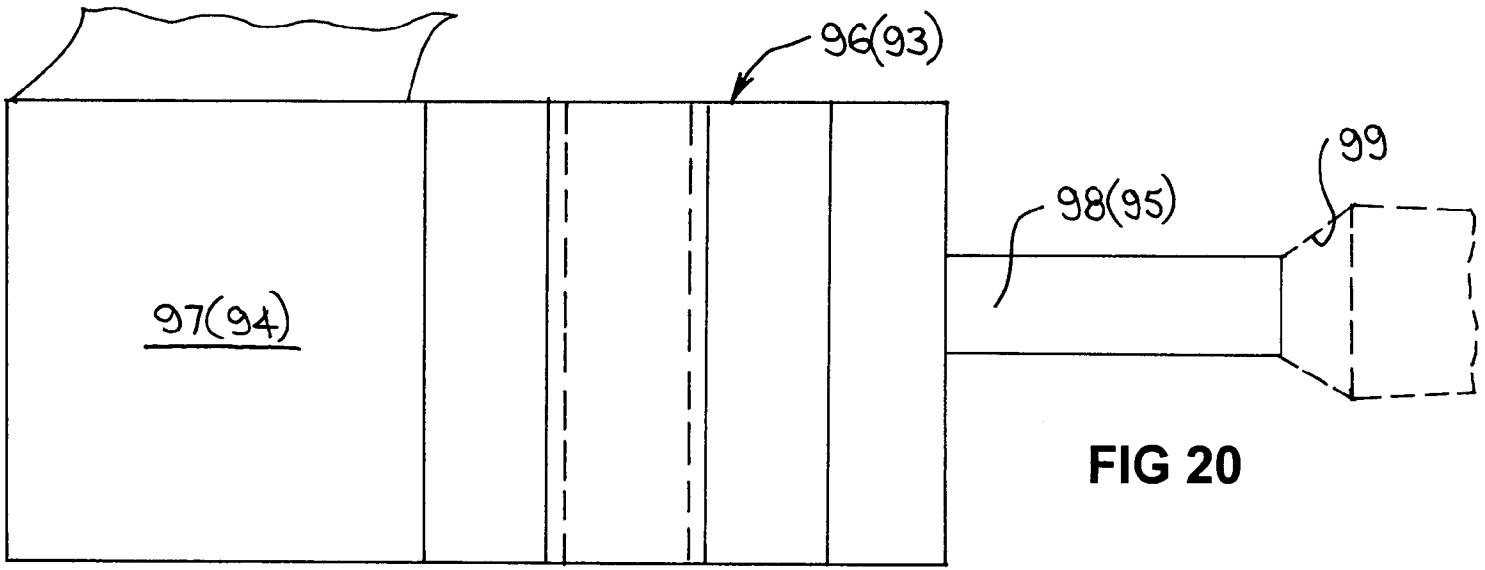
FIG. 20 is a schematic representation of part of the seventh embodiment in plan view.

To obtain the tensile bars 91, the casting 90 is cut along the junction between each end of tie 92 and the respective side of each bar 91 while metal 93 is severed from the side of the tensile bar 91 to which it is attached. The shape of the severed metal 93 is shown in more detail in FIGS. 20 and 21. The metal 93 of course has the same form as a corresponding section 96 of a metal flow system according to the present invention and further description of metal 93 in FIGS. 20 and 21 is with reference to metal 93 as if representing that corresponding section 96. Metal sections 94 and 95 thus are taken as respectively representing the CEM 97 and the CEP 98 of the corresponding metal flow system. To continue this representation of CEM 97 and CEP 98, an outlet end section of a runner 99, through which alloy passes to the inlet end 98*a* of the CEP 98, is shown in broken outline. Also the shading depicts respective mould halves 101 and 102 which are separable on parting line P-P and which define the die cavities and metal flow system.

As can be seen from FIGS. 20 and 21, the CEM 97 has an overall rectangular form, with the runner 99 and CEP 98 longitudinally in-line. The outlet end 98*b* of the CEP 98 communicates with the CEM 97 at the middle of one end of the CEM. Thus, the alloy flows in the direction of runner 99 and CEP 98, through the CEM 97 towards its end remote from the CEP outlet 98*b*. However, towards that remote end, the CEM 97 opens laterally to a short secondary runner 100 through which alloy is able to pass to the first of in-series die cavities in which tensile bars 91 are cast.

Along a first part of its length from CEP outlet 98*b*, the CEM 97 is of a form which generates resistance to alloy flow therethrough. This is achieved by alternate ribs 101*a* and 102*a*, defined by the respective mould parts, which extend laterally with respect to alloy flow through the CEM 97, and which protrude into the general rectangular form of the CEM. The width of the CEM 97 and the minimum distance A between successive ribs is calculated so that a required flow velocity for a given alloy is achieved. Thus, for example, a magnesium alloy which changes state from liquid to semi-solid in its flow through CEP 98 by being reduced in flow velocity from 150 m/s at inlet 98*a* to 100 m/s at outlet 98*b*, is able to be further reduced in flow velocity in its flow through CEM 97 whereby the alloy is retained in its semi-solid state throughout the die cavities even if increasing in flow velocity to a degree during that flow.

With a metal flow system of the form shown in FIGS. 20 and 21, tensile test bars 91 as shown in FIG. 19 were able to be produced, with the microstructure in the gauge length and the gripping ends of each bar 91 showing retention of a uniform fine microstructure indicative of rapid solidification of semi-solid alloy. Moreover, the first bar 91 was found to be substantially free of porosity, while the second bar 91 also was substantially free of porosity except for an acceptable degree of porosity in its last to fill, gripping end. This is in marked contrast to results obtainable with conventional pressure die casting, using flow from one end in producing tensile bars. With that conventional casting, unsatisfactory die cavity fill at the remote end of the first die cavity usually is experienced, while producing two tensile bars in series essentially is not practical.

As indicated above, flow velocities for achieving the required change in alloy from its molten state to a semi-solid or thixotropic state depends on the alloy to be used. For a magnesium alloy, the flow velocity at the inlet end of the CEP generally is in excess of about 60 m/s, preferably at about 140 to 165 m/s. For an aluminium alloy, the inlet end flow velocity generally is in excess of 40 m/s, such as about 80 to 120 m/s. For other alloys, such as zinc and copper alloys, capable of being converted to a semi-solid or thixotropic state, the CEP inlet end flow velocity generally is similar to that for aluminium alloys, but can vary with unique properties of individual alloys. The reduction in flow velocity to be achieved in the CEP generally is such as to achieve a flow velocity at the CEP outlet end which is from about 50 to 80%, such as from 65 to 75% of the flow velocity at the inlet end. The further reduction in flow velocity obtained in the CEM of the system of the invention, i.e. between the outlet end of the CEP and the inlet to the or each die cavity may range from 20 to 65% of the flow velocity at the outlet end of the CEP. The arrangement preferably is such that an increase in flow velocity in the or each die cavity, if any, during flow throughout the or each die cavity is to a level not exceeding about 75% of the flow velocity at the outlet end of the CEP.

Finally, it is to be understood that various alterations, modifications and/or additions may be introduced into the constructions and arrangements of parts previously described without departing from the spirit or ambit of the invention.

The invention claimed is:

1. A metal flow system for high pressure die casting of alloys using a machine having a pressurised source of molten alloy and a mould defining at least one die cavity, wherein the system defines a metal flow path by which alloy received from the pressurised source is able to flow into the die cavity, wherein:

(a) a first part of the length of the flow path includes a runner and a controlled expansion port (CEP) which increases in cross-sectional area, in the direction of alloy flow therethrough, from an inlet end of the CEP at an outlet end of the runner to an outlet end of the CEP; and (b) a CEP exit module (CEM) which forms a second part of the length of the flow path from the outlet end of the CEP; and wherein the increase in cross-sectional area of the CEP is such that molten alloy, received at the CEP inlet end at a sufficient flow velocity, undergoes a reduction in flow velocity in its flow through the CEP whereby the alloy is caused to change from a molten state to a semi-solid state, and wherein the CEM has a form which controls the alloy flow whereby the alloy flow velocity decreases progressively from the level at the outlet end of the CEP whereby, at the location at which the flow path communicates with the die cavity, the alloy flow velocity is at a level significantly below the level at the outlet end of the CEP, such that the change in state generated in the CEP is maintained substantially throughout filling of the die cavity and such that the alloy is able to undergo rapid solidification in the die cavity and back along the flow path towards the CEP.

2. The metal flow system of claim 1, wherein the CEM defines or comprises a channel which has a width substantially in excess of its depth and a cross-sectional area greater than the area of the outlet end of the CEP.

3. The metal flow system of claim 2, wherein the channel enables alloy flowing into it from the CEP to spread radially and thereby undergo a reduction in flow velocity.

4. The metal flow system of claim 2, wherein the cross-sectional area of the channel increases in the direction of alloy flow to thereby decrease alloy flow velocity.

5. The metal flow system of claim 2, wherein the channel along at least part of its length is of a saw-toothed or corrugated configuration to define peaks and troughs across its width.

6. The metal flow system of claim 1, wherein the CEM defines or comprises a channel having width and depth dimensions of the same order, and a transverse cross-section which progressively increases in the direction of alloy flow therein.

7. The metal flow system of claim 6, wherein the channel communicates with the die cavity at an end of the channel remote from the CEP.

8. The metal flow system of claim 6, wherein the channel communicates with the die cavity along a side of the channel.

9. The metal flow system of claim 8, wherein the channel is of curved or arcuate form along at least that part of its length at which it communicates with the die cavity.

10. The metal flow system of claim 6, wherein the channel is of a bifurcated form to provide a pair of arms which diverge from the outlet end of the CEP.

11. The metal flow system of claim 1, wherein the form of the CEM is reduction in alloy flow velocity produced therein is from 20% to 65% of the alloy flow velocity at the outlet end of the CEP.

12. A method of producing alloy castings using a high pressure die casting machine having a pressurised source of molten alloy and a mould defining at least one die cavity, in which the alloy flows from the source to the die cavity along a flow path, wherein:

(a) the alloy, in a first part of the flow path, is caused to flow through a controlled expansion port (CEP) which increases in cross-sectional area between inlet and outlet ends of the CEP, whereby the alloy undergoes an increase in its cross-sectional area of flow and a resultant decrease in flow velocity, from an initial sufficient flow velocity at the inlet end, thereby to produce change in the alloy from a molten state to a semi-solid state; and (b) controlling the alloy flow in a second part of the flow path, defined by a CEP exit module (CEM), extending between the outlet end of the CEP and the die cavity, whereby the flow velocity progressively decreases from the level at the outlet end of the CEP to a flow velocity where the flow path communicates with the die cavity which is at a level significantly below the level at the outlet of the CEP;

such that the change in state produced in the CEP is maintained substantially throughout filling of the die cavity.

13. The process of claim 12, wherein the reduction in flow velocity in the CEM is that alloy in the die cavity is unable to revert to a significant extent to the liquid state.

14. The process of claim 12, wherein the alloy proceeds through the CEM on a front which remains substantially normal to the flow direction.

15. The process of claim 12, wherein the alloy proceeds through the CEM on a front which spreads so as to progress substantially tangentially to radial diverging flow directions.

16. The process of claim 12, wherein the reduction in alloy flow velocity produced in the CEM is from 20% to 65% of the alloy flow velocity at the outlet end of the CEP.

* * * * *